United States Patent [19]

Gerhardy et al.

[11] Patent Number: 4,936,267

[45] Date of Patent: Jun. 26, 1990

[54] CARBURETOR FOR AN INTERNAL COMBUSTION ENGINE

[75] Inventors: Reinhard Gerhardy, Korb; Michael Wissmann, Schorndorf-Weiler, both of Fed. Rep. of Germany

[73] Assignee: Andreas Stihl, Fed. Rep. of Germany

[21] Appl. No.: 267,847

[22] Filed: Nov. 7, 1988

[30] Foreign Application Priority Data

Nov. 6, 1987 [DE] Fed. Rep. of Germany ..... 3737667
Jul. 12, 1988 [DE] Fed. Rep. of Germany ..... 3823525

[51] Int. Cl.[5] ..... F02M 1/16; F02M 17/04

[52] U.S. Cl. ..... 123/179 G; 123/180 T; 123/437; 261/35; 261/39.5; 261/51; 261/DIG. 8; 261/DIG. 68

[58] Field of Search ..... 123/179 G, 437, 179 A, 123/179 C, 180 R, 180 T; 261/DIG. 8, DIG. 68, 35, 51, 39.5

[56] References Cited

U.S. PATENT DOCUMENTS

| | | | |
|---|---|---|---|
| 1,221,620 | 4/1917 | Steininger | 123/180 R |
| 2,724,584 | 11/1955 | Armstrong | 261/DIG. 68 |
| 2,728,564 | 12/1955 | Bracke | 261/DIG. 68 |
| 3,272,143 | 9/1966 | Rice | 261/DIG. 68 |
| 3,371,658 | 3/1968 | Turner | 261/DIG. 8 |
| 4,079,708 | 3/1978 | Wieland et al. | 123/179 C |
| 4,386,594 | 6/1983 | Szloboda | 261/DIG. 68 |
| 4,563,311 | 1/1986 | Agnew | 261/DIG. 68 |

FOREIGN PATENT DOCUMENTS

| | | | |
|---|---|---|---|
| 55-156237 | 12/1980 | Japan | 261/DIG. 8 |

*Primary Examiner*—Andrew M. Dolinar
*Attorney, Agent, or Firm*—Walter Ottesen

[57] ABSTRACT

The invention relates to a carburetor for an internal combustion engine and especially for a portable small engine. The carburetor includes a carburetor housing defining an intake pipe and a control chamber which communicates with the intake pipe via intake channels. A fuel-feed line which is closable by an inlet valve opens into the control chamber. The inlet valve includes a valve seat formed in the fuel-feed line and a valve body mounted on a positioning lever which is connected to a membrane defining a wall of the control chamber. The positioning lever can be pivotally actuated to open the inlet valve to admit fuel into the control chamber. An actuating lever is pivotally mounted on the carburetor housing and can be pivoted from a rest position to an active position whereat the actuating lever applies a force against the membrane to displace the latter and pivotally actuate the positioning lever to immediately open the inlet valve when starting the engine.

15 Claims, 6 Drawing Sheets

CARBURETOR FOR AN INTERNAL COMBUSTION ENGINE

FIELD OF THE INVENTION

The invention relates to a carburetor for an internal combustion engine and especially for portable small engines. The carburetor includes an intake pipe and a control chamber which communicates with the intake pipe via intake channels. A fuel-feed line which is closable by an inlet valve opens into the control chamber. The inlet valve includes a valve body mounted on a positioning lever which is connected to a membrane defining a wall of the control chamber. The positioning lever can be actuated to open the inlet valve to admit fuel into the control chamber.

BACKGROUND OF THE INVENTION

Carburetors of the kind described above are known from published German patent application No. DE-OS 3,127,516. In this known carburetor, the inlet valve is opened by means of the pressure of the fuel pump which occurs when starting the engine so that the fuel can flow into the control chamber and through the inlet channels into the intake pipe. As soon as the engine is started and runs, a switchover valve interrupts the applied pressure so that the inlet valve returns to its closed position. Especially with longer use of the carburetor, the danger is presented that the inlet valve becomes dirtied by the combustion residue in the crankcase so that it can no longer close without difficulty. Disturbances during normal operation of the carburetor can occur in this way.

SUMMARY OF THE INVENTION

It is an object of the invention to improve the above-described carburetor so that, on the one hand, the inlet valve moves into its open position without difficulty for starting the engine while, on the other hand, the inlet valve is reliably returned to its closure position after the engine has been started and is running.

The carburetor of the invention is for an internal combustion engine, especially for a portable small engine. The carburetor includes: a carburetor housing defining an intake pipe communicating with the engine and through which air is drawn when the engine is operating; the carburetor housing further defining an interior space; a displaceable control membrane disposed in the interior space so as to form a control chamber therein bounded by the membrane; inlet channel means for passing fuel from the control chamber to the intake pipe for mixing with the air in the latter to form an air/fuel mixture for the engine; a fuel-feed line for conducting fuel into the control chamber; an inlet valve for metering fuel from the fuel-feed line into the control chamber, the valve including a valve seat formed in the fuel-feed line, and a valve body movable through a displacement path between a first position wherein the valve body is in contact engagement with the valve seat to interrupt the flow of fuel into the chamber and a second position away from the valve seat to allow fuel to enter the control chamber; a positioning lever pivotally mounted in the housing and being connected to the membrane so as to be movable in response to displacements of the latter; the valve body being mounted on the positioning lever so as to the movable into the second position in response to a displacement of the membrane; and, actuating means for acting on the membrane to displace the latter so as to cause the positioning lever to pivot and bring the valve body into the second position thereby opening the valve.

In the carburetor according to the invention, the inlet valve is positively displaced into its open position. The positioning lever which includes the inlet valve body can be actuated without difficulty with the actuator for opening this valve so that the fuel from the fuel-feed line can flow into the control chamber for the starting operation. Since the pressure in the crankcase no longer has to be applied for opening the inlet valve, the latter can be opened already before starting the engine. The fuel then reaches the control chamber unimpeded during the starting operation. Possible contaminants therefore do not settle on the valve seat so that the inlet valve reliably closes the fuel-feed line after the engine has started.

According to a further embodiment of the invention, the opening of the inlet valve is positively coupled with the displacement of the throttle flap into the start position. Accordingly, when the inlet valve is opened for starting, the throttle flap is positively pivoted into the start position provided for starting. Failure conditions when starting the engine are precluded as a consequence of this positive coupling. The inlet valve can be opened with only a single switching or selection member and, with this movement, the throttle flap can be displaced into the start position. The inlet valve is definitively opened in a positive manner. In this way, a rapid start is assured because the starting pump pressure acts unimpeded through the open inlet valve to move the fuel from the control chamber into the intake pipe of the carburetor. Since adequate air is available via the throttle flap, a run-up and full speed running of the engine is assured which is adjusted with the aid of the defined positive opening of the inlet valve and the start position of the throttle flap. In this way, the engine is prevented from receiving too much fuel and not turning over when starting.

With the carburetor of the invention, a hot start is also possible without difficulty because possible occurring vapor bubbles are moved rapidly through and out of the carburetor. For this reason, only a single start position can be provided for the carburetor according to the invention which is suitable for cold as well as hot starts.

When the opening of the inlet valve is coupled with the displacement of the throttle flap into the start position, then it is assured that the inlet valve will in no event be mechanically opened in the idle position of the throttle flap.

A through-flow limiter is arranged in the fuel-feed line which is dimensioned to allow fuel to pass through in correspondence to the maximum fuel requirement of the engine. This prevents an overenrichment of the air/fuel mixture during the starting operation and assures a run-up to full speed of the engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
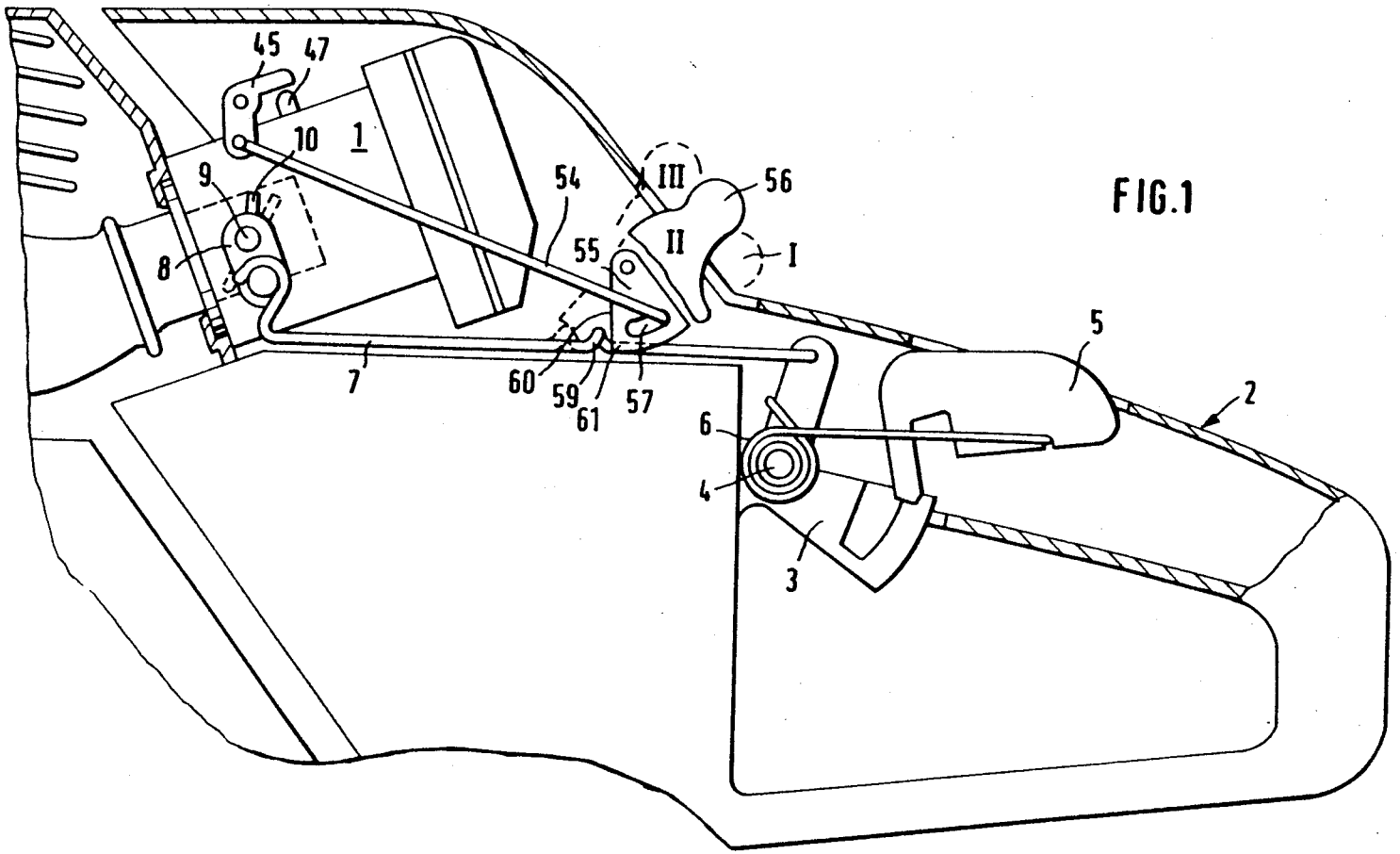
FIG. 1 is a side elevation view, partially in section, of a portion of a motor-driven chain saw equipped with a carburetor according to the invention.

The carburetor shown in the drawing is for internal combustion engines and especially for portable small engines. In the embodiment shown, the carburetor is built into the drive motor of a motor-driven chain saw. The carburetor can also be used as the drive motor of a brushcutter, spraying apparatus or the like. The carburetor is a so-called membrane carburetor which includes a fuel pump driven by the pressure fluctuations in the crankcase of the engine so that the fuel is present under pressure at the inlet valve to the control chamber. Because of the underpressure which builds up in the intake pipe of the carburetor, fuel present in the control chamber is drawn by suction through the inlet channels and directed with aspirated air to the combustion chamber of the engine as an air/fuel mixture.

Referring now to the drawing, the carburetor 1 in FIG. 1 is part of a motor-driven chain saw of which only a portion is schematically illustrated. The chain saw has a rear handle 2 in which a throttle trigger 3 is journalled to pivot about an axis 4. The throttle trigger 3 can only be actuated when a pivotally journalled throttle lock 5 is depressed. The throttle trigger 3 is resiliently biased by means of a spring 6 in the direction toward its initial position. The throttle trigger 3 is linked to a throttle linkage 7 which connects the trigger 3 with a positioning member 8. The positioning member 8 is fixedly attached to a throttle flap shaft 9 of the carburetor 1 and this shaft 9 carries the throttle flap 10. By actuating the throttle trigger 3, the throttle flap 10 is pivoted via the throttle linkage 7.

Figure 2:
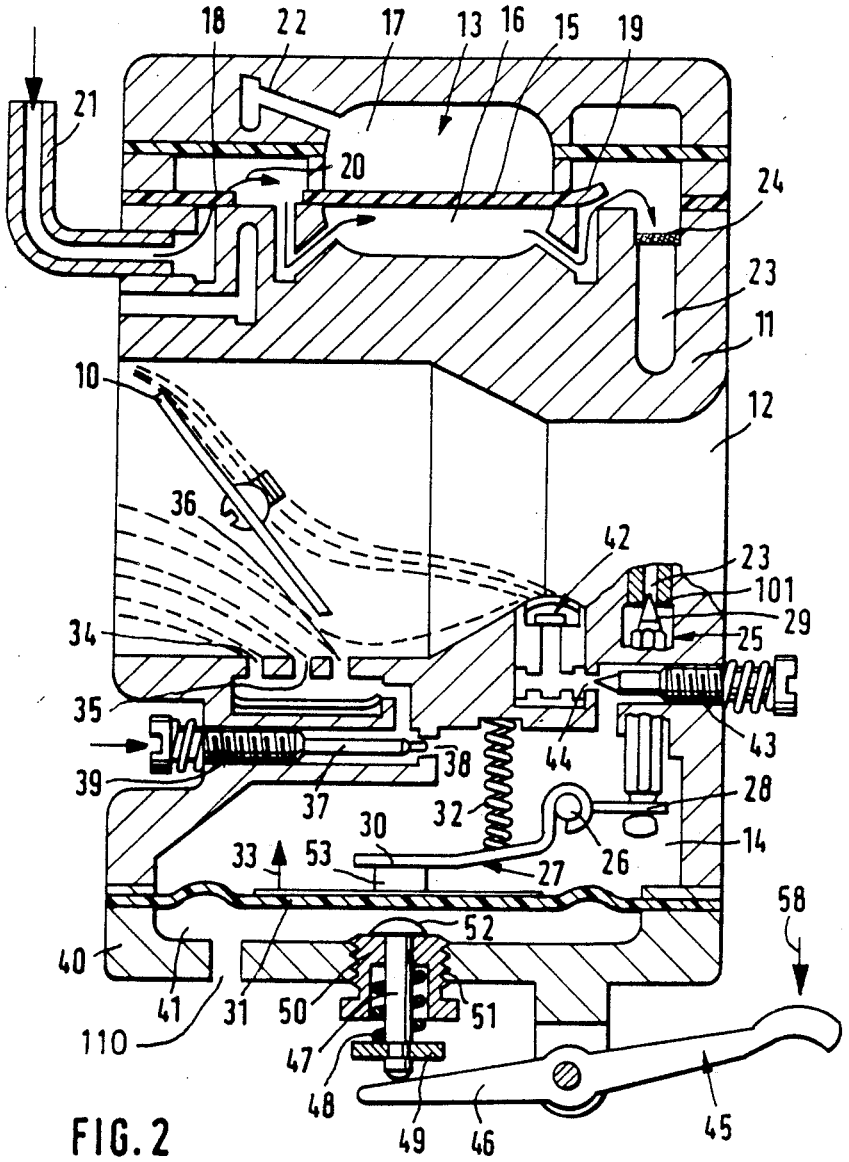
FIG. 2 is a side elevation view, partially in section, of the carburetor of FIG. 1.

As shown in FIG. 2, the carburetor 1 has a housing 11 with an intake pipe 12. A fuel pump 13 and a control chamber 14 are also provided in the housing 11.

The fuel pump 13 is configured as a membrane pump and has a membrane 15 which partitions a work chamber of the fuel pump into a fuel-feed chamber 16 and a pressure chamber 17. The fuel-feed chamber 16 is secured at its input and output ends by means of check valves 18 and 19, respectively, so that a flow of fuel in the direction of arrow 20 is assured when the membrane 15 is pumped.

The fuel-feed chamber 16 is connected to a fuel tank (not shown) via connection 21 whereas a line 22 leads from the pressure chamber 17 to the crankcase. The pressure fluctuations present in the crankcase are utilized in a known manner for pumping fuel.

A fuel filter 24 is mounted in the fuel-feed line 23 leading to the control chamber 14 for filtering contaminants in the fuel as may be required. The fuel-feed line 23 to the control chamber 14 is closed by means of an inlet valve 25 which includes a two-armed lever 27 pivotable about an axis 26. One of the lever arms 28 of the two-armed lever 27 includes an inlet valve body 29 and the other lever arm 30 is connected with a membrane 31 defining a wall of the control chamber 14. A spring 32 acts on lever arm 30 and develops a force holding the inlet valve body 29 tightly against the valve seat 101 in the fuel-feed line 23. With a movement in the direction of arrow 33 in the sense of reducing the control chamber 14, the membrane 31 effects an opening of the inlet valve 25 in that the two-arm lever 27 is pivoted against the force of spring 32 in the clockwise direction so that the inlet valve body 29 separates from valve seat 101 and opens the fuel-feed line 23.

Three inlet channels 34 to 36 open from control chamber 14 into the suction pipe 12. Of these inlet channels, inlet channel 34 lies on the side of the throttle flap 10 facing toward the combustion chamber when the throttle flap is in the idle position. The inlet channel 34 therefore forms the idling jet. When the throttle flap 10 is pivoted by the actuation of the throttle trigger 3, fuel is aspirated into the intake pipe 12 from the neighboring inlet channel 35 because of the changing pressure relationship (part-load range). When the throttle flap 10 is pivoted to its end position, fuel is drawn into the intake pipe 12 also via the inlet channel 36 (full-load range).

The fuel flow to the intake pipe 12 is adjustable by means of a through-flow quantity controller comprised of a valve needle 37 which is axially adjustable and a through-flow opening 38 through which the fuel flows from the control chamber 14 to the inlet channels 34 to 36. The valve needle 37 is adjustably held by means of an adjusting screw 39 in the carburetor housing 11. The membrane 31 on the side facing away from the control chamber 14 and the closure cover 40 fixed with threaded fasteners to the carburetor housing conjointly define a chamber 41 which communicates with the atmosphere by means of at least one opening 110.

The control chamber 14 is also provided with a main jet 42 from which fuel can flow into the intake pipe 12. The cross section of a through-flow opening 44 to the main jet 42 can be precisely adjusted by means of an adjusting screw 43 provided in the carburetor housing 11.

For actuating the inlet valve 25, an actuating lever 45 is pivotally journalled on the carburetor housing 11 and is preferably configured as a two-arm lever. A push rod 47 acts under the force of a pressure spring 48 against the one lever arm 46 of actuating lever 45. The pressure spring is braced with its one end on a holding ring 49 seated on the push rod 47 and, with its other end, the pressure spring is braced against the base of a cup-shaped insert piece 50 which accommodates the pressure spring 48 as shown. The insert piece 50 is threadably engaged in a threaded bore 51 of the closure cover. The push rod 47 projects through a bore of the insert piece 50 and carries a widened head 52 at its free end with which it lies against the insert piece 50 under the force of pressure spring 48 as shown in FIG. 2. The two-armed lever 27 is connected with the membrane 31 via an attachment piece 53. In the initial position, the attachment piece 53 is disposed so as to lie in spaced relationship adjacent to the head 52 of push rod 47.

As shown in FIG. 1, the actuating lever 45 is connected with displacing member 55 via a pull rod 54. The displacing member 55 is part of a positioning shaft (not shown) which can be rotated by selection member 56 into different positions. For starting the engine, the selection member 56 is pivoted into the position I indicated in dotted outline. When the engine is started, the selection member 56 is then moved into the position II indicated by the solid line. The selection member 56 is displaced into the stop position III indicated in dotted outline when the engine is to be switched off. Since the displacing member 55 is fixed so as to rotate with the selection member 56, the displacing member 55 is displaced in the same measure as the selection member 56.

The displacing member 55 includes a slot 57 having the shape of a segment of a circle through which one end of the pull rod 54 projects. When the selection member 56 assumes the operating position II, then the pull rod 54 lies with its corresponding end against the right-hand edge of slot 57 as shown in FIG. 1. In this operating position, the actuating lever 45 assumes the initial position shown in FIG. 2 in which the push rod 47 is spaced from the membrane 14 so that the inlet valve 25 is released into the closure position. The inlet valve 25 then adjusts itself after a transition phase to the normal operating condition corresponding to the requirement of the engine. Pivoting the selection member 56 into the stop position III has no influence on the actuating lever 45. Because of the configuration of the slot 57, the pull rod 54 is not taken along with this pivoting movement of the selection member 56 and the displacing member 55.

For starting the engine, the selection member 56 together with the displacing member 55 are pivotally displaced into the start position I. With this displacing movement, the actuating lever is taken along by the displacing member 55 after it passes through the operating position II. The actuating lever 45 is pivoted in the direction indicated by arrow 58 in FIG. 2 whereby the push rod 47 is displaced against the force of pressure spring 48 via lever arm 46 thereby coming into pushing contact engagement with attachment piece 53 which, in turn, causes the membrane 31 to be pressed in the direction toward the control chamber 14. In this way, the two-arm lever 27 is pivoted against the force of pressure spring 32 thereby causing inlet valve 25 to open the fuel-feed line 23. When starting the engine equipped with the above-described carburetor, fuel can flow into the control chamber 14 and out of inlet channels 34 and 44 without the requirement that a substantial underpressure be present in the intake pipe 12. In this way, the enriched mixture required for the starting operation is directed to the combustion chamber without having to generate an underpressure in the intake pipe by means of an additional manipulation such as via the starting flap. A starter flap is therefore not necessary in a carburetor of this kind.

As soon as the engine runs, the selection member 56 is returned from the starting position I into the operating position II. The pressure spring 32 loads the inlet valve 25 in the direction of its closure position which then adjusts itself to the normal operating condition corresponding to the requirements of the engine in the manner described. The pressure spring 48 presses the push rod 47 back whereby the actuating lever 45 is pivoted into its initial position in the direction opposite to arrow 58. In the operating position II of the selection member 56, the actuating device (45, 47) takes on the initial position for the inlet valve 25 shown in FIG. 2. The carburetor conducts the fuel for forming the mixture by means of the underpressure in the intake pipe 12.

By displacing the selection member 56 into the start position I, not only is the actuator lever 45 displaced, but, the throttle flap 10 is simultaneously pivoted into the start position as shown by the dashed outline in FIG. 1. For this purpose, the throttle linkage 7 is provided with a projecting intermediate segment 59 which is in contact engagement with the edge 60 of the displacing member 55 in the operating position II of the selection member 56 (solid outline in FIG. 1). If the selection member 56 is not displaced into the start position I, the throttle linkage 7 is pushed via the displacing member 55 because the intermediate segment 59 of the throttle linkage lies in the displacement path of the displacing member 55. With this movement, the throttle flap 10 is pivoted via the positioning member 8 into its start position (dashed outline in FIG. 1). The displacing member 55 has a projecting forward portion 61 which, in the start position, is engaged at the rear by the intermediate segment 59 as shown by the dashed outlines. In this way and when the inlet valve 25 is opened, the throttle flap 10 is also simultaneously pivoted into the location required for the start position by the selection member 56.

The opening movement of the inlet valve 25 is therefore positively coupled with the displacement of the throttle flap into the start position. In this way, an optimal mixture enrichment during the starting operation is assured. Incorrect manipulations by the operator of the chain saw are precluded in this manner. With a single displacing movement of the selection member 56 out of the operating position II into the start position I, the respective positions of the inlet valve 25 and the throttle flap 10 are obtained which are optimal for the starting operation. In addition, an adequate quantity of fuel is made available for the starting operation by the positive opening of the inlet valve 25.

To more clearly show the invention, only one start position is shown. Since the chain saw is usually started with the chain brake applied, two start positions are provided. However, for chain saws not having such a brake, one starting position is adequate.

In the operating position II of the selection member 56, the throttle linkage is free of the displacing member 55 so that the throttle flap 10 can be pivoted with the throttle trigger 3 unimpeded into the different positions. Since the insert piece 50 (FIG. 2) in the closure cover 40 is a threaded member, it is possible to compensate in a simple manner for tolerances between the position of the insert piece and the attachment piece 53 of the double lever 27. In this way, it is assured that the inlet valve 25 clears the fuel-feed line 23 to the desired extent when pivoting the actuating lever 45. Basically, it is also possible to adjust the opening path of the inlet valve 25 with the insert piece 50, for example, in order to compensate for tolerances or to make a fine adjustment of the inlet valve 25. In this way, the possibility is provided to optimally adjust the carburetor.

Figure 3:
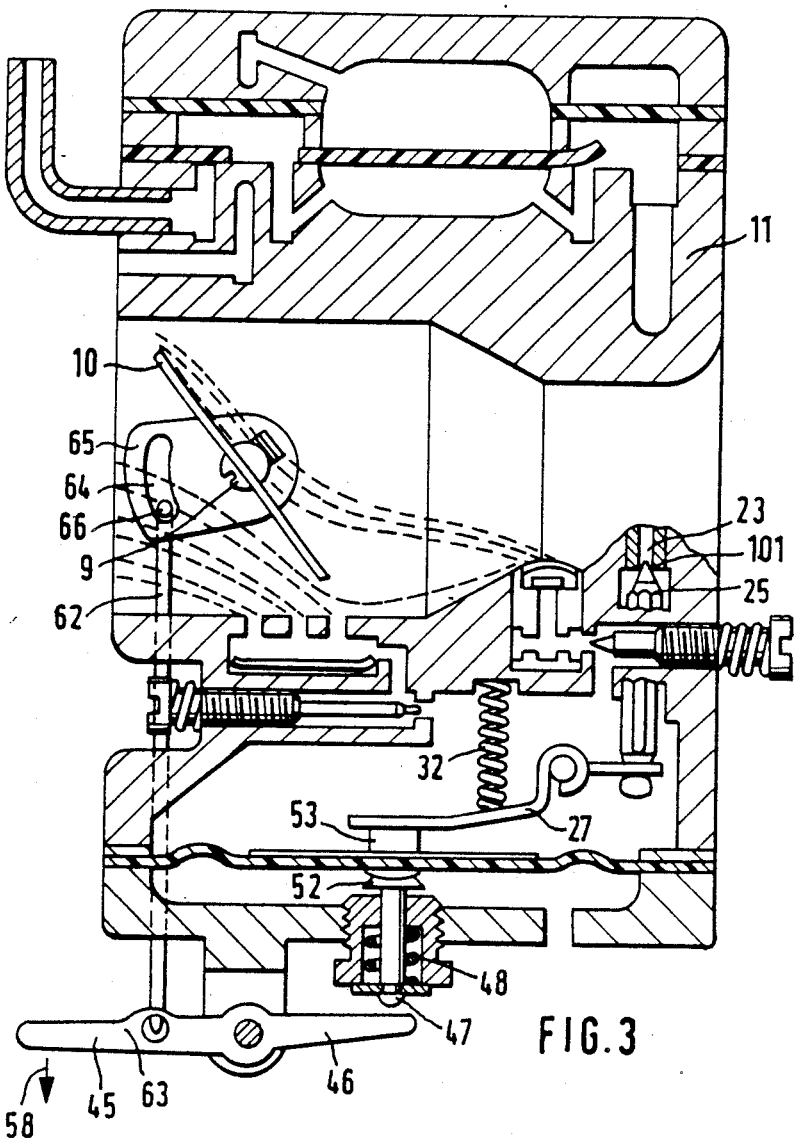
FIG. 3 is a second embodiment of the carburetor of the invention illustrated in the manner of FIG. 2.

In the embodiment of FIG. 3, the positive coupling between the actuating lever 45 and the throttle flap 10 is not via the throttle linkage. Instead, a positive coupling is provided via a coupling rod 62. The coupling rod 62 is linked to the lever arm 63 of the actuating lever 45 in the region outside of the carburetor housing 11. The coupling rod 62 furthermore engages a slot 64 of a positioning member 65 seated on the throttle flap shaft 9 so as to be rotatable therewith. The slot 64 is in the form of a segment of a circle having as its center the throttle flap shaft 9. The positioning member 65 is disposed outside of the carburetor housing 11.

FIG. 3 shows the start position of the carburetor in which the inlet valve 25 is opened and the fuel feed line 23 is clear. The actuating lever 45 is pivoted in the direction of arrow 58 so that the two-arm lever 27 is pivoted against the force of the spring 32 via the lever arm 46 of lever 27 and the push rod 47. When the actuating lever 45 is pivoted, the positioning member 65 is taken along via the coupling rod 62 whereby the throttle flap 10 is pivoted into the start position shown in FIG. 3. The actuating lever 45 can be connected with the selection member 56 in the manner shown in FIG. 1 and as described with respect thereto. When the selection member 56 is displaced out of the operating position II into the start position I, then the actuating lever 45 is pivoted in the direction of arrow 58 by means of the pull rod 54. The actuating lever 45 can also be connected to a separate selection member. When the actuating lever 45 is pivoted, not only is the inlet valve 25 opened, but also and simultaneously therewith, the throttle flap 10 is pivoted into the start position via the coupling rod 62. In this way, and also for this embodiment, it is assured that the inlet valve and the throttle flap take on a precisely predetermined position with respect to one another in the start position so that the engine can be started without difficulty. Incorrect operation and starting difficulties are precluded because the actuating lever 45 and the throttle flap 10 do not have to be displaced independently of one another.

After the engine is started and running, and as described with respect to the embodiment of FIGS. 1 and 2, the actuating lever 45 is again pivoted back so that the push rod 47 is returned under the force of pressure spring 48 until its head 52 is contact disengaged from the attachment piece 53 of the two-arm lever 27. The two-arm lever 27 is pivoted back in the direction toward its initial position by the pressure spring 32. The circular segment shaped slot 64 in the positioning member 65 is so configured that the throttle flap 10 with the positioning member 65 in the operating position of the carburetor can be pivoted back unimpeded from the idle position into the full-load position with the throttle trigger 3 by means of the coupling rod 62. Preferably, in the idle position of the throttle flap 10, the coupling rod 62 is disposed at a small spacing from the end 66 of the slot 64 facing toward the actuating lever 45.

With respect to its remaining features, the embodiment shown in FIG. 3 is the same as that shown in FIGS. 1 and 2.

Figure 4:
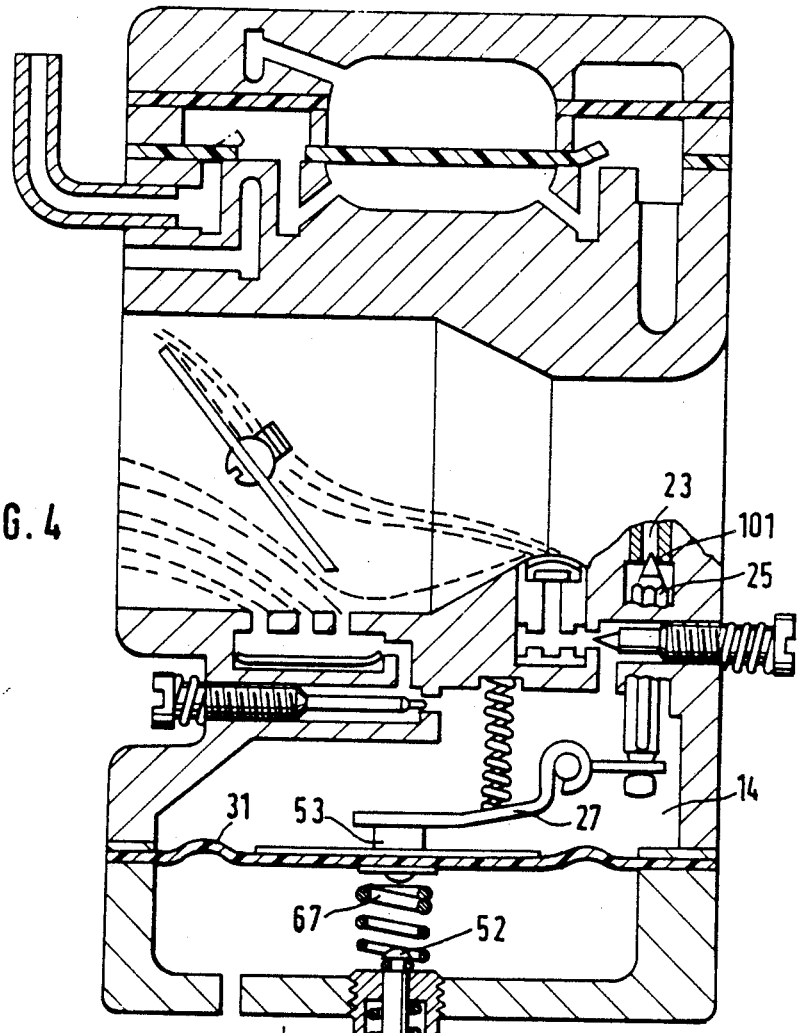
FIG. 4 is a third embodiment of the carburetor according to the invention in a representation corresponding to that of FIG. 2.

In the embodiment of FIG. 4, the push rod 47 acts with its head 52 not directly on the attachment piece 53 of the two-arm lever 27; instead, the push rod 47 acts on the attachment piece 53 via a pressure spring 67 arranged therebetween. The force transmission from the push rod 47 to the control membrane 31 is therefore not rigid but is instead spring loaded. The control operation can be adjusted in accordance with the force of the pressure spring utilized. The pressure spring 67 applies a biasing force to the control membrane 31 as soon as it comes into contact engagement with the attachment piece 53 when the actuating lever, not shown in FIG. 4, is pivoted. In this way, and with a predetermined displacement path 68 of the push rod 47, the two-arm lever 27 can pivot to a greater extent so that the inlet valve 25 can be moved further away from its valve seat so that more fuel can flow into the control chamber 14 from the fuel-feed line 23.

The remaining components of the carburetor of FIG. 4 have the same configuration as those shown for FIGS. 1 and 2.

The embodiment of FIG. 3 can also be provided with a pressure spring 67 between the push rod 47 and the attachment piece 53.

Figure 5:
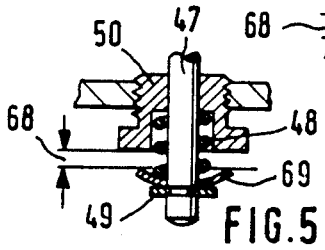
FIG. 5 is an embodiment of the push rod unit of the carburetor of FIG. 4.
Figure 6:
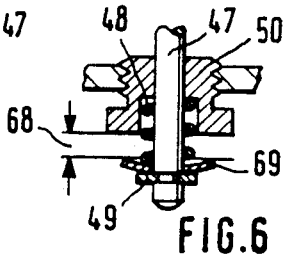
FIG. 6 is another embodiment of the push rod unit for the carburetor shown in FIG. 4.

FIGS. 5 and 6 show an embodiment wherein the opening path of the inlet valve 25 can be made dependent upon temperature so that at low ambient temperatures, the inlet valve can be opened further for obtaining a richer mixture of fuel and air than with higher ambient temperatures. For this purpose, a bimetal plate spring 69 is seated on the holding ring 49 of the push rod and on which the pressure spring 48 surrounding the push rod 47 is supported.

The bimetal plate spring 69 is so configured that it has a flat plate shape (FIG. 6) at lower temperatures whereas the plate spring 69 has a deeper dish shape (FIG. 5) at higher ambient temperatures. If low ambient temperatures are present, then the dish spring 69 takes on the form shown in FIG. 6. The dish spring 69 acts as an abutment when the push rod 47 is displaced and comes to rest against the insert piece 50. Since the bimetal plate spring 69 has a flat shape, the displacement path 68 of the push rod 47 is relatively large. The actuating lever 45 can therefore be pivoted relatively far until the bimetal plate spring 69 comes to rest on the insert piece 50. The two-arm lever 27 is also correspondingly pivoted relatively far so that the inlet valve 25 can be opened wide. In this way, a relatively large quantity of fuel from the fuel-feed line 23 reaches the control chamber 14. If the engine is started at these low ambient temperatures, a relatively rich mixture of fuel and air is provided making a cold start possible.

If on the other hand, higher ambient temperatures are present, then the bimetal plate spring 69 takes on a more curved shape as shown in FIG. 5. In this way, the displacement path 68 of the push rod 47 is less than at low ambient temperatures. By displacing the push rod 47 by means of the actuating lever 45, the bimetal plate spring 69 comes to rest earlier on the insert piece 50 than with the embodiment according to FIG. 6. For this reason, the two-arm lever 27 can be pivoted a lesser amount so that the inlet valve 25 is displaced only slightly. A correspondingly lesser amount of fuel thereby reaches the control chamber 14 from the fuel-feed line 23. In this way, a corresponding lean air/fuel mixture is available for the starting operation at higher ambient temperatures.

The bimetal plate spring 69 takes on different intermediate positions between the two positions of FIGS. 5 and 6 in dependence upon the ambient temperature whereby the displacement path of the inlet valve 25 is simply determined in dependence upon the ambient temperature.

The configuration of FIGS. 5 and 6 can be utilized in all of the carburetors described above in order to obtain a temperature dependent adjustment of the inlet valve in a simple manner.

Figure 7:
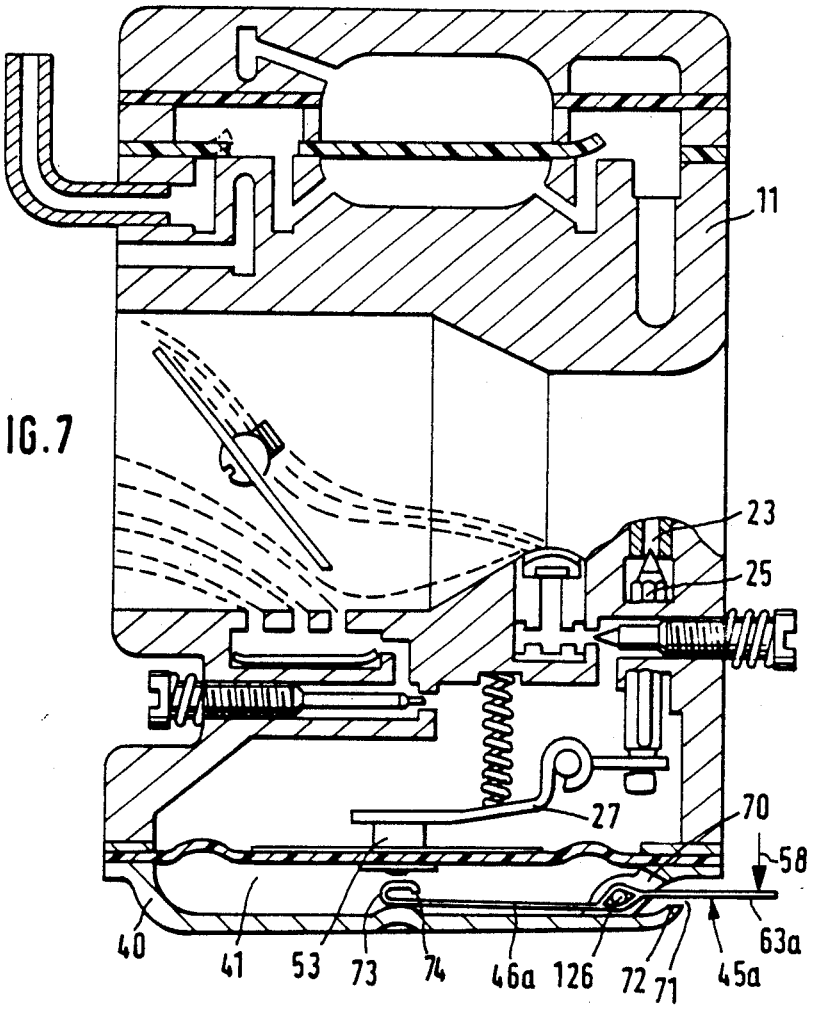
FIG. 7 is a fourth embodiment of a carburetor according to the invention in a representation corresponding to that of FIG. 2.

In the embodiment of FIG. 7, the actuating lever 45a is not outside the carburetor housing 11 and is instead disposed within the pressure chamber 41. Only its one lever arm 63a projects out from the pressure chamber 41. The closure cover 40 is provided with a strut 70 for pivotally journalling the actuating lever 45a and this strut 70 includes the pivot shaft 26 for the actuating lever 45a. The closure cover 40 has an opening 71 through which the arm 63a of the actuating lever 45a projects. The forward edge 72 of the opening 71 viewed in the pivot direction defines an abutment for limiting the pivot path of the actuating lever 45a.

The actuating lever 45a can be rigidly configured as is the actuating lever of the previously described embodiments. The lever arm 46a can, however, also be resiliently configured.

In contrast to the previous embodiments, the lever arm 46a of the actuating lever 45a comes directly into contact with the attachment piece 53 of the two-arm lever 27 when the inlet valve 25 is to be opened. This configuration is thereby characterized by a very simple constructive configuration.

The actuating lever 45a can also be made of a bimetal and can be so configured that at least the end portion of the lever arm 46a, which coacts with the attachment piece 53, can carry out temperature-dependent deformations whereby the pivot path of the actuating lever 45a and therefore the displacement path of the inlet valve 25 can automatically change in dependence upon the particular ambient temperature present. In the illustrated embodiment, the free end 73 of the lever arm 46a is bent back upon itself to define a loop. The two-arm lever 27 is pivoted to open the inlet valve 25 by means of this free end 37 when the actuating lever 45a is pivoted.

The loop-shaped end 73 is so configured that the loop-shaped end is spaced from the lever arm 46a. The lever arm 46a made of bimetal is configured such that the loop-shaped end 73 expands at low ambient temperatures so that when the actuating lever 45a is pivoted, the widened end 73 comes into early contact with the attachment piece 53 thereby pivoting the two-arm lever 27 through a wide angle. On the other hand, if the ambient temperatures are high, then the loop-shaped end 73 pulls closed and it can pull closed until the end face 74 of the free end 73 comes into contact engagement with the lever arm 46a. In this case, the free end 73 comes into contact engagement with the attachment piece 53 only after the actuating lever 45a passes through a larger pivot path so that the two-arm lever 27 can be pivoted only by means of the remaining pivot path of the actuating lever 45a. The inlet valve 25 is then only slightly opened and this slight opening of the fuel feed line 23 is provided for the hot start whereas the wide opening is advantageous for the cold start.

Figure 8:
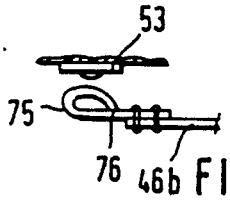
FIG. 8 is an enlarged view of the free end of the displacement lever of the carburetor of FIG. 7 wherein the free end is equipped with a bimetal loop.
Figure 9:
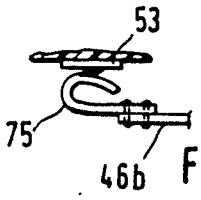
FIG. 9 is an enlarged view of the free end of the displacing lever shown in FIG. 8 wherein the bimetal loop has expanded in response to a change in ambient temperature.

FIGS. 8 and 9 show a variation of the carburetor of FIG. 7. A separate bimetal part 75 is attached to the free end of lever arm 46b. The bimetal part 75 corresponds in its configuration to the free end 73 of lever arm 46a of FIG. 7. FIG. 8 shows the one end position of the bimetal part 75 which takes on an abutting position with its end face 76. The bimetal part 75 takes on this position at higher ambient temperatures.

In contrast, lower ambient temperatures are present for the position shown in FIG. 9. The bimetal part 75 has expanded so that it is in contact engagement with the attachment piece 53. For this condition, when the actuating lever is pivoted, the attachment piece 53 and the two-arm lever 27 are pivoted immediately whereas in the position of FIG. 8, the actuating lever must first pass through an open space before the bimetal part 75 comes into contact engagement on the attachment piece 53 and only then is the two-arm lever pivoted with a further pivoting of the actuating lever. In this case, the inlet valve 25 is only slightly opened whereas in the position of FIG. 9, the inlet valve 25 is pushed back substantially farther.

Accordingly, the inlet valve 25 is in this way also controlled in dependence upon temperature as described with respect to the embodiments of FIGS. 7 to 9. The carburetor of FIG. 7 corresponds to the configuration of FIGS. 1 and 2. In the variation of FIGS. 8 and 9, the bimetal part 75 can be simply exchanged after it is worn or damaged.

Figure 10:
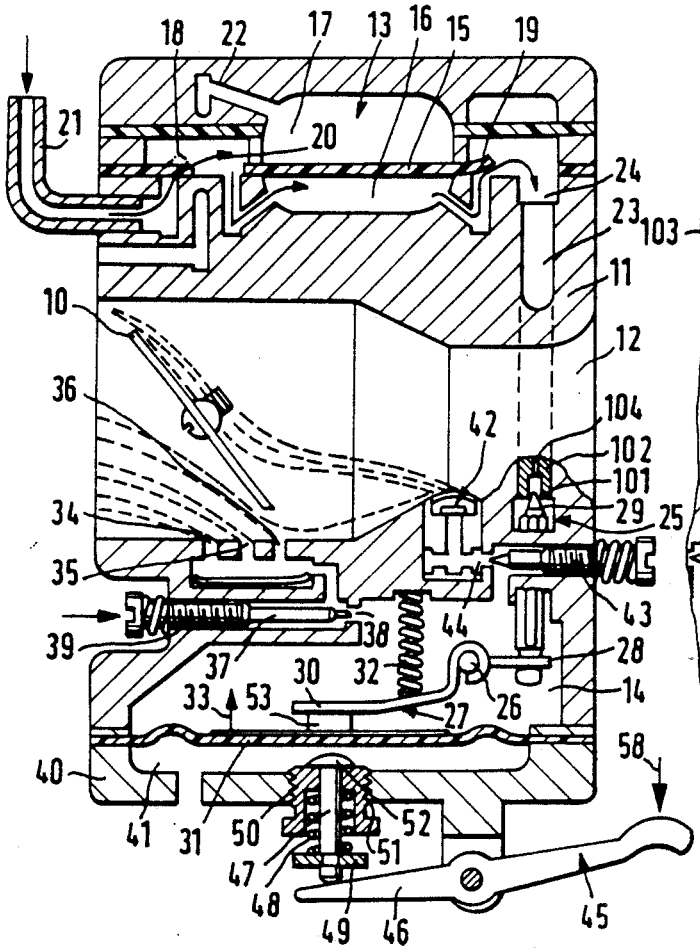
FIG. 10 is still another embodiment of the carburetor according to the invention again being shown in a representation corresponding to that of FIG. 2 and equipped with a through-flow limiter arranged in the fuel-feed line; and, FIG. 11 is a portion of the carburetor of FIG. 11 equipped with another embodiment of a through-flow limiter.
Figure 11:
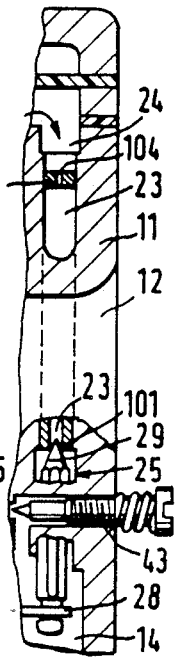

FIGS. 10 and 11 show a further embodiment of the invention wherein a through-flow limiter (102 or 103) is mounted in the fuel-feed line 23. This through-flow limiter (102, 103) is configured as a calibrating nozzle in the embodiment shown and has a through-pass bore 104 for the through-flow of the fuel. The cross section or diameter of the through-pass bore 104 is substantially less than the diameter of the bore defining the valve seat 101. The through-pass bore 104 is so dimensioned that the fuel passed therethrough is limited to an upper limit value which corresponds approximately to the maximum fuel required for starting and run-up of the engine.

In the embodiment of FIG. 10 as well as in the embodiment of FIG. 11, the through-flow limiter (102, 103) is disposed ahead of the inlet valve 25 when viewed in the fuel flow direction. In FIG. 10, the through-flow limiter 102 is preferably configured with the valve seat 101 as one component with the pass-through bore 104 being mounted directly ahead of the valve seat 101 and this pass-though bore 104 opens into the bore defining the valve seat. In the embodiment of FIG. 11, the through-flow limiter 103 is disposed just behind the fuel filter 24 in the inlet region of the fuel-flow line 23. The through-flow limiter 103 is here configured as a disc having an essentially annular shape with the fuel through-pass bore 104 extending axially through the disc.

When starting the engine, the inlet valve 25 is mechanically opened in the manner described so that the fuel flows into the control chamber 14 and can flow out through the inlet channels 34 and 44 without a substantial underpressure having to be present in the intake pipe 12. A limitation of the metered fuel quantity is obtained by means of the through-flow limiter (102 or 103) when starting the engine so that the mixture is not too rich which is especially advantageous for small engines.

Most importantly, the valve seat 101 seals and controls with the inlet valve body 29 and can therefore not be configured as small as desired. For this reason, the calibration nozzle (102 or 103) is arranged ahead of the valve seat when viewed in the direction of the flow of fuel and is dimensioned for the maximum requirement of fuel.

It is understood that the foregoing description is that of the preferred embodiments of the invention and that various changes and modifications may be made thereto without departing from the spirit and scope of the invention as defined in the appended claims.

What is claimed is:

1. A carburetor for an internal combustion engine, especially for a portable small engine, the carburetor comprising:

a carburetor housing defining an intake pipe communicating with the engine and through which air is drawn when the engine is operating;

said carburetor housing further defining an interior space;

a displaceable control membrane disposed in said interior space so as to form a control chamber therein bounded by said membrane;

inlet channel means for passing fuel from said control chamber to said intake pipe for mixing with the air in the latter to form an air/fuel mixture for the engine;

a fuel-feed line for conducting fuel into said control chamber;

an inlet valve for metering fuel from said fuel-feed line into said control chamber, said valve including a valve seat formed in said fuel-feed line, and a valve body movable through a displacement path between a first position wherein said valve body is in contact engagement with said valve seat to interrupt the flow of fuel into said chamber and a second position away from said valve seat to allow fuel to enter said control chamber;

a positioning lever pivotally mounted in said housing and being connected to said membrane so as to be movable in response to displacements of the latter;

said valve body being mounted on said positioning lever so as to be movable into said second position in response to a displacement of said membrane;

actuating means for acting on said membrane to displace the latter so as to cause said positioning lever to pivot and bring said valve body into said second position thereby opening said valve;

said actuating means including an actuating lever pivotally mounted on said housing so as to be pivotally movable between a rest position whereat no force is applied to said membrane and an active position whereat said actuating lever applies a force against said membrane to displace the latter and pivot said positioning lever to bring said valve body into said second position;

said actuating means further including a push rod mounted in said carburetor housing; and, spring means for resiliently biasing said push rod toward said actuating lever thereby tending to pivot the latter into said rest position;

said push rod being displaceably journalled in said housing so as to come into contact with and displace said control membrane when said actuating lever is pivoted into said active position thereby moving said inlet valve body via said positioning lever;

said actuating means further including an insert piece mounted in said carburetor housing for journalling said push rod therein; and, said insert piece being mounted in said carburetor housing so as to be adjustable in elevation with respect to the latter to adjust the displacement through which said push rod passes when acted upon by said actuating lever thereby effecting an adjustment of the displacement of said membrane and the quantity of fuel admitted to said control chamber.

2. A carburetor for an internal combustion engine, especially for a portable small engine, the carburetor comprising:

a carburetor housing defining an intake pipe communicating with the engine and through which air is drawn when the engine is operating;

said carburetor housing further defining an interior space;

a displaceable control membrane disposed in said interior space so as to form a control chamber therein bounded by said membrane;

inlet channel means for passing fuel from said control chamber to said intake pipe for mixing with the air in the latter to form an air/fuel mixture for the engine;

a fuel-feed line for conducting fuel into said control chamber;

an inlet valve for metering fuel from said fuel-feed line into said control chamber, said valve including a valve seat formed in said fuel-feed line, and a valve body movable through a displacement path between a first position wherein said valve body is in contact engagement with said valve seat to interrupt the flow of fuel into said chamber and a second position away from said valve seat to allow fuel to enter said control chamber;

a positioning lever pivotally mounted in said housing and being connected to said membrane so as to be movable in response to displacements of the latter;

said valve body being mounted on said positioning lever so as to be movable into said second position in response to a displacement of said membrane;

actuating means for acting on said membrane to displace the latter so as to cause said positioning lever to pivot and bring said valve body into said second position thereby opening said valve;

said actuating means including an actuating lever pivotally mounted on said housing so as to be pivotally movable between a rest position whereat no force is applied to said membrane and an active position whereat said actuating lever applied a force against said membrane to displace the latter and pivot said positioning lever to bring said valve body into said second position;

a throttle flap pivotally mounted in said intake pipe so as to be rotatable into a start position; and, positive coupling means for positively coupling said throttle flap to said actuating lever so as to bring said throttle flap into said start position when said actuating lever is moved into said active position.

3. The carburetor of claim 2, wherein the carburetor is mounted in a housing structure for accommodating the engine and comprises: a throttle trigger and a throttle linkage interconnecting said throttle flap and said throttle trigger; and, an operating mode selection member mounted on said housing so as to be movable between a start-up position and an operate position; and, said positive coupling means including a force transmitting member connecting said actuating lever to said selection member for moving said actuating lever into said active position when said selection member is moved into said start-up position; and, releasable engaging means for releasably engaging said throttle linkage to move said throttle flap into said start position when said selection member is moved into said start-up position.

4. The carburetor of claim 2, said throttle flap including a throttle flap shaft mounted in said carburetor housing so as to permit the pivotal movement thereof; said positive coupling means comprising: a positioning member fixedly mounted to said throttle flap shaft so as to be pivotable therewith; curved slot means having respective ends and being formed in said positioning member so as to be curved about the axis of said throttle flap shaft; and, a pull rod connected to said actuating lever and engaging said curved slot means at one of said ends for applying a pivot force to said positioning member so as to bring said throttle flap into said start position when said actuating lever is pivoted into said active position.

5. The carburetor of claim 2, said actuating means further comprising: a push rod mounted in said carburetor housing; and, spring means for resiliently biasing said push rod toward said actuating lever thereby tending to pivot the latter into said rest position; and, said push rod being displaceably journalled in said housing so as to come into contact with and displace said control membrane when said actuating lever is pivoted into said active position thereby moving said inlet valve body via said positioning lever.

6. The carburetor of claim 5, said actuating means further comprising a pressure spring interposed between said control membrane and said push rod whereby said push rod acts upon said control membrane via said pressure spring.

7. The carburetor of claim 5, said actuating means further comprising an insert piece mounted in said carburetor housing for journalling said push rod therein; and, said insert piece being mounted in said carburetor housing sc as to be adjustable in elevation with respect to the latter to adjust the displacement through which said push rod passes when acted upon by said actuating lever thereby effecting an adjustment of the displacement of said membrane and the quantity of fuel admitted to said control chamber.

8. The carburetor of claim 5, said actuating means further comprising ambient temperature-dependent means interposed between said spring means and said push rod for adjusting the displacement through which said push rod passes when acted upon by said actuating lever thereby effecting an adjustment of the displacement of said membrane and the quantity of fuel admitted to said control chamber in dependence upon ambient temperature.

9. The carburetor of claim 2, comprising ambient temperature-dependent means interposed between said membrane and said actuating lever for deforming in dependence upon ambient temperature so as to adjust the displacement of said membrane imparted to the latter by said actuating lever.

10. The carburetor of claim 9, said actuating lever having an end for acting on said membrane when imparting a displacing movement thereto; and, said temperature-dependent means being a bimetal member mounted at said end of said actuating lever so as to be interposed between the latter and said membrane.

11. The carburetor of claim 2, comprising through-flow limiting means disposed in said fuel-feed line for limiting the fuel passing to said control chamber to an amount corresponding to the maximum fuel requirement of the engine.

12. The carburetor of claim 11, said through-flow limiting means being a calibrating nozzle.

13. The carburetor of claim 11, said through-flow limiting means being arranged in said fuel-feed line ahead of said inlet valve.

14. The carburetor of claim 13, said through-flow limiting means being disposed directly ahead of said valve seat so as to conjointly define a component piece therewith.

15. The carburetor of claim 11, said fuel-feed line having an input and said carburetor comprising a fuel filter disposed in the vicinity of said input; and, said through-flow limiting means being disposed in said fuel-feed line so as to be next to said fuel filter and in spaced relationship to said inlet valve.

* * * * *

UNITED STATES PATENT AND TRADEMARK OFFICE

CERTIFICATE OF CORRECTION

PATENT NO. : 4,936,267

DATED : June 26, 1990

INVENTOR(S) : Reinhard Gerhardy and Michael Wissmann

It is certified that error appears in the above-identified patent and that said Letters Patent is hereby corrected as shown below:

In column 1, line 66: delete "the", second occurrence, and substitute --be-- therefor.

In column 6, line 19: delete "not" and substitute -- now -- therefor.

In column 12, line 41: delete "applied" and substitute -- applies -- therefor.

In column 13, line 32: delete "sc" and substitute -- so -- therefor.

Signed and Sealed this

Twenty-first Day of January, 1992

*Attest:*

*Attesting Officer*

HARRY F. MANBECK, JR.

*Commissioner of Patents and Trademarks*